US005462418A

United States Patent [19]

Shimizu et al.

[11] Patent Number: 5,462,418

[45] Date of Patent: Oct. 31, 1995

[54] SCROLL TYPE COMPRESSOR EQUIPPED WITH MECHANISM FOR RECEIVING REACTION FORCE OF COMPRESSED GAS

[75] Inventors: Izuru Shimizu; Tetsuo Yoshida; Masao Iguchi; Tetsuhiko Fukanuma, all of Kariya, Japan

[73] Assignee: Kabushiki Kaisha Toyoda Jidoshokki Seisakusho, Kariya, Japan

[21] Appl. No.: 226,508

[22] Filed: Apr. 12, 1994

Related U.S. Application Data

[63] Continuation-in-part of Ser. No. 128,827, Sep. 29, 1993.

[30] Foreign Application Priority Data

Apr. 13, 1993 [JP] Japan ..... 5-018758 U

[51] Int. Cl.[6] ..... F04C 18/04; F16D 3/04

[52] U.S. Cl. ..... 418/55.3; 464/102

[58] Field of Search ..... 418/55.3, 55.6; 464/102

[56] References Cited

U.S. PATENT DOCUMENTS 4,406,600 9/1983 Terauchi et al. ..... 418/55.3

FOREIGN PATENT DOCUMENTS 59-28082 2/1984 Japan .

2291490 12/1990 Japan ..... 418/55.3

*Primary Examiner*—John J. Vrablik

*Attorney, Agent, or Firm*—Brooks Haidt Haffner & Delahunty

[57] ABSTRACT

Disclosed is a compressor which has a fixed scroll and a movable scroll. Defined between both scrolls is a compression chamber in order to provide compressed gas. A pressure receiving member receives compression reaction force of the compressed gas. A base plate is provided on the movable scroll. A turnable ring is disposed between the pressure receiving member and the base plate. The ring has the first and second surfaces respectively facing the pressure receiving member and the base plate. The first surface of the ring has a plurality of first elements circumferentially spaces and provided at predetermined intervals. A plurality of first recesses are provided in the pressure receiving member, with the first elements fitted into the first recesses respectively. The second surface of the ring has a plurality of second elements circumferentially spaced and provided at predetermined intervals. A plurality of second recesses are provided in the base plate, with the second elements fitted into the second recesses respectively. When the movable scroll revolves, the first and second elements move within the first and second recesses to prevent rotation of the movable scroll and the ring. To transmit the compression reaction force of the gas acting on the movable scroll to the pressure receiving member, the first and second surfaces of the ring are provided with a plurality of projections protruding toward the pressure receiving member and the base plate and having substantially spherical engagement surfaces to engage therewith.

10 Claims, 10 Drawing Sheets

SCROLL TYPE COMPRESSOR EQUIPPED WITH MECHANISM FOR RECEIVING REACTION FORCE OF COMPRESSED GAS

This is a continuation-in-part of co-pending U.S. application Ser. No. 08/128,827 filed Sep. 29, 1993 which is incorporated herein by reference.

BACKGROUND OF THE INVENTION

1. Field of the Invention

The present invention relates to a scroll type compressor. More particularly, the present invention relates to a scroll type compressor which includes a mechanism for transmitting reaction force of a refrigerant gas, applied to an orbiting scroll, to the housing of the compressor and allows the orbiting scroll to make proper orbital movement.

2. Description of the Related Art

Scroll type compressors include a basic structure having a fixed scroll and an orbiting scroll facing each other in its housing. As a rotary shaft rotates, the orbiting scroll makes an orbital movement along a predetermined locus (hereinafter called "revolution"). As the orbiting scroll revolves, the volume of the space defined between the fixed scroll and orbiting scroll decreases to compress a refrigerant gas. In reaction to the rotation of the rotary shaft, the orbiting scroll tends to rotate around its axis (hereinafter called "rotation"). It is however necessary to prevent the orbiting scroll from rotating around its own axis, and to keep it horizontally and vertically aligned in order to optimize the compressor's operation.

Japanese Unexamined Patent Publication No. 59-28082 discloses a compressor which is equipped with an anti-rotation mechanism as mentioned above. In this compressor, as shown in FIG. 9, an orbiting scroll 102, disposed facing a fixed scroll 100 in a housing H, receives the reaction force of a compressed refrigerant gas in compression chambers 106 due to the rotational force of a rotary shaft 104. The rear surface of a base plate 108 of the scroll 102 abuts against a pressure receiving wall 112 of the housing via an anti-rotation mechanism 110.

The mechanism 110 includes a movable ring 118 and a fixed ring 120 which are disposed between the base plate 108 and the wall 112 via races 114 and 116, respectively (see FIG. 10). The movable ring 118 moves integrally with the orbiting scroll 102. The rings 118, 120 have a plurality of pockets 122 and 124, spaced within the circumferences of the rings 118 and 120, at equal intervals, respectively. Rod shaped rollers 126 are supported between the associated pockets 122 and 124 which face each other.

When the scroll 102 and the movable ring 118 rotate in reaction to the rotation of the rotary shaft 104, the rollers 126 roll in the region between the associated pockets 122 and 124. Accordingly, the orbiting scroll 102 performs the orbital movement without rotating itself.

The diameter, d, of the roller 126, which inhibits the rotation of the orbiting scroll 102, the diameter, D, of the pockets 122 and 124, and the orbital radius, r, of the orbiting scroll 102 have the following relation.

$$D=d+r$$

Therefore, the diameter d of the rollers 126 is defined by the orbit radius r of the orbiting scroll 102 and the diameter D of the pockets 122 and 124.

The end surfaces of each roller 126 slidably contact the races 114 and 116. The compression reaction force applied to the orbiting scroll 102 is transmitted to the wall 112 via the rollers 126. To improve the rigidity of the compressor, either the diameter d or the actual number of the rollers 126 should be increased. Increasing the diameter d of the rollers 126 requires that the diameter D of the pockets 122 and 124 should be increased. The enlarged pockets 122 and 124 require the movable ring 118 and the fixed ring 120 to be wider. However, the wider rings 118 and 120 would enlarge the compressor, and it is not desirable to mount such a large compressor in a vehicle.

To increase the ability for receiving the compression reaction force without enlarging the compressor, it is necessary to increase the number of the rollers 126. However, the increased number of rollers 126 results in an increase in the number of the pockets 122 and 124. The increase in the number of the pockets 122 and 124, which requires a high precision process, leads to longer processing time and higher manufacturing cost.

The end surfaces of the rollers 126 slide along the bottom surfaces of the pockets 122 and 124. With the rollers 126 in close contact with the pockets 122 and 124, inadequate lubrication is likely to occur therebetween which may cause increased friction there.

If any roller tilts in the associated pocket, the peripheral edge of that roller abuts on the bottom surface of the pocket, interfacing with the smooth sliding therebetween. In this case, the peripheral edge of that roller locally wears out, so that the roller would tilt more.

When the inclination of the roller increases, the sliding surface of the roller to the inner wall of the associated pocket becomes an elliptical and the diameter d of the roller changes. This change varies the orbit radius r of the orbiting scroll. This results in inadequate sliding contact between the spiral wall of the fixed scroll and the spiral wall of the orbiting scroll, so that gas may not be adequately compressed.

SUMMARY OF THE INVENTION

It is therefore an object of the present invention to provide a scroll type compressor which requires fewer pockets than the conventional compressor and a simplified manufacturing process and low manufacturing cost.

It is another object of the present invention to provide a scroll type compressor, which has a simplified structure with a smaller number of parts, and which can ensure a smooth operation of members that slide in contact with an orbiting scroll and a pressure receiving wall while receiving compression reaction force therebetween.

To achieve the foregoing and other objects and in accordance with the purpose of the present invention, an improved scroll type compressor is provided. This compressor has a fixed scroll and a movable scroll revolvable supported, facing the fixed scroll. Defined between both scrolls is a compression chamber whose volume is reduced according to the revolution of the movable scroll to compress gas. A pressure receiving member receives compression reaction force of gas in the compression chamber. A base plate is provided on the movable scroll. A turnable ring is disposed between the pressure receiving member and the base plate. The ring has first and second surfaces respectively facing the pressure receiving member and the base plate. One of the pressure receiving member and the first surface of the ring has a plurality of first elements (rollers) provided in a circumferential direction at predetermined intervals. A plurality of first recesses are provided in one of the pressure receiving member and the first surface of the ring, with the first elements fitted in the second recesses respectively. One of the base plate and the second surface of the ring has a plurality of second elements provided in a circumferential direction at predetermined intervals. A plurality of second recesses are provided in one of the base plate and the second surface of the ring, with the second elements fitted in the second recesses respectively. When the movable scroll revolves, the first and second elements move within the first and second recesses to prevent rotation of the movable scroll and the ring. To transmit the compression reaction force of the gas acting on the movable scroll to the pressure receiving member, the first and second surfaces of the ring are provided with a plurality of projections protruding toward the pressure receiving member and the base plate and having nearly spherical engagement surfaces to engage therewith.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENT

One embodiment of the present invention will now be described specifically, with reference to FIGS. 1 through 4.

Figure 1:
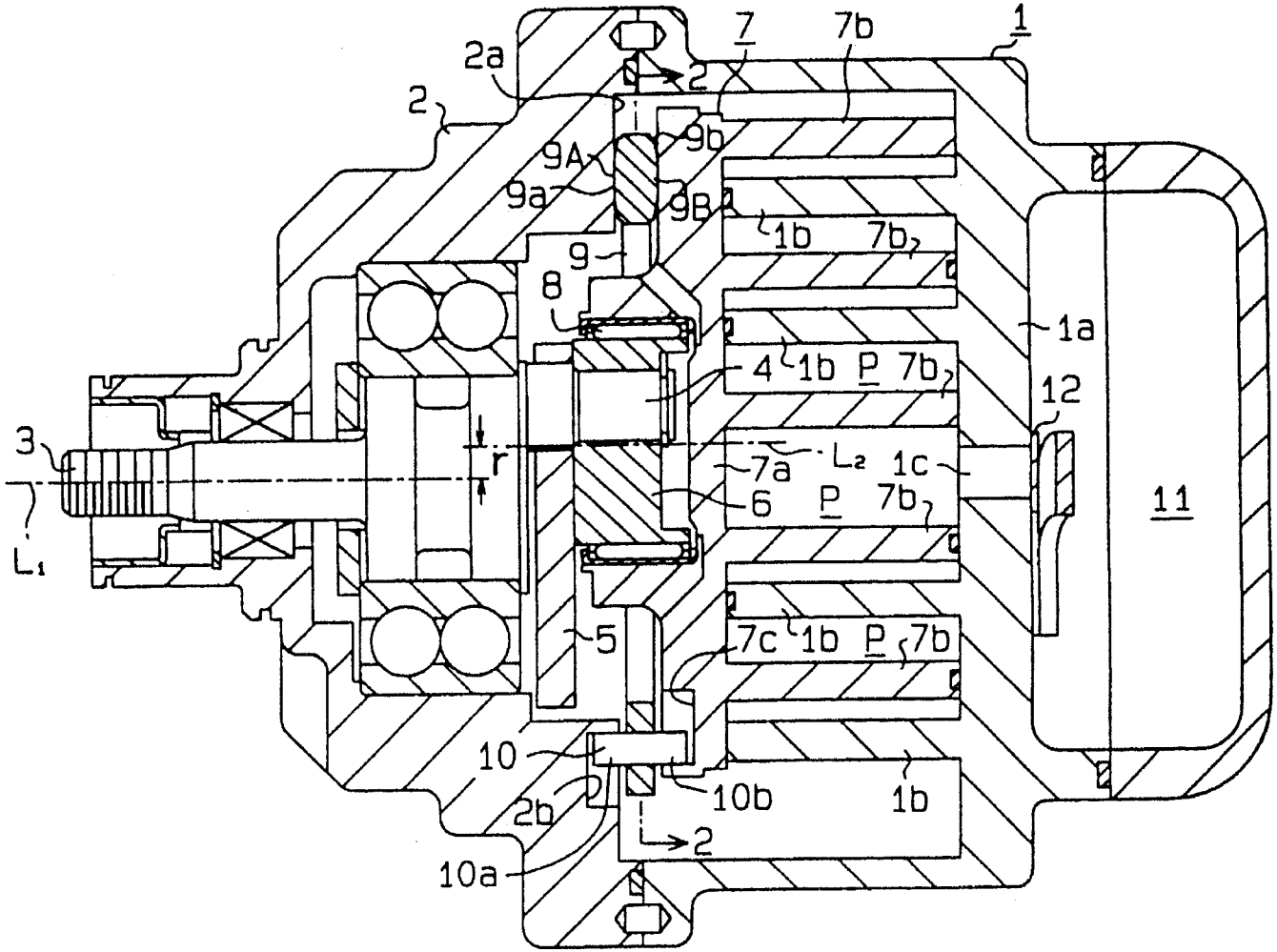
FIG. 1 is a side elevation showing a scroll type compressor according to one embodiment of the present invention.

As shown in FIG. 1, a front housing 2 is secured to a fixed scroll 1 that also serves as a rear housing. A rotary shaft 3 is rotatably supported in the front housing 2, and an eccentric shaft 4 is secured to the rotary shaft 3.

A balancing weight 5 and a bushing 6 are rotatably supported by the eccentric shaft 4. An orbiting scroll 7, rotatably supported by the bushing 6 via radial bearings 8, contacts the fixed scroll 1. A compression chamber P is defined by base plates 1*a* and 7*a* and spiral walls 1*b* and 7*b* of the scrolls 1 and 7.

When the eccentric shaft 4 revolves about the axis L1 of the rotary shaft 3 and the orbiting scroll 7 makes an orbital movement at the same time, the refrigerant gas is introduced through an inlet port (not shown) into the compression chamber P between the scrolls 1 and 7. The compression chamber P decreases its volume while the orbiting scroll 7 makes its orbital movement. At the same time, the compression chamber P is shifted toward the center portions of the spiral walls 1*b* and 7*b* of the scrolls 1 and 7. As a result, the refrigerant gas is gradually compressed in the compression chamber P. The compressed gas is then discharged into a discharge chamber 11 through a discharge port 1*c* formed in the base plate 1*a*. The discharge port 1*c* is normally shut off and is openable by means of a discharge valve 12 on the discharge chamber side.

A description will now be given of a mechanism which prevents the orbiting scroll 7 from rotating around its own axis when the scroll 7 makes an orbital movement, and a structure which receives the compression reaction force of the refrigerant gas reacting on the orbiting scroll 7 when the refrigerant gas is compressed.

Figures 4, 4A:
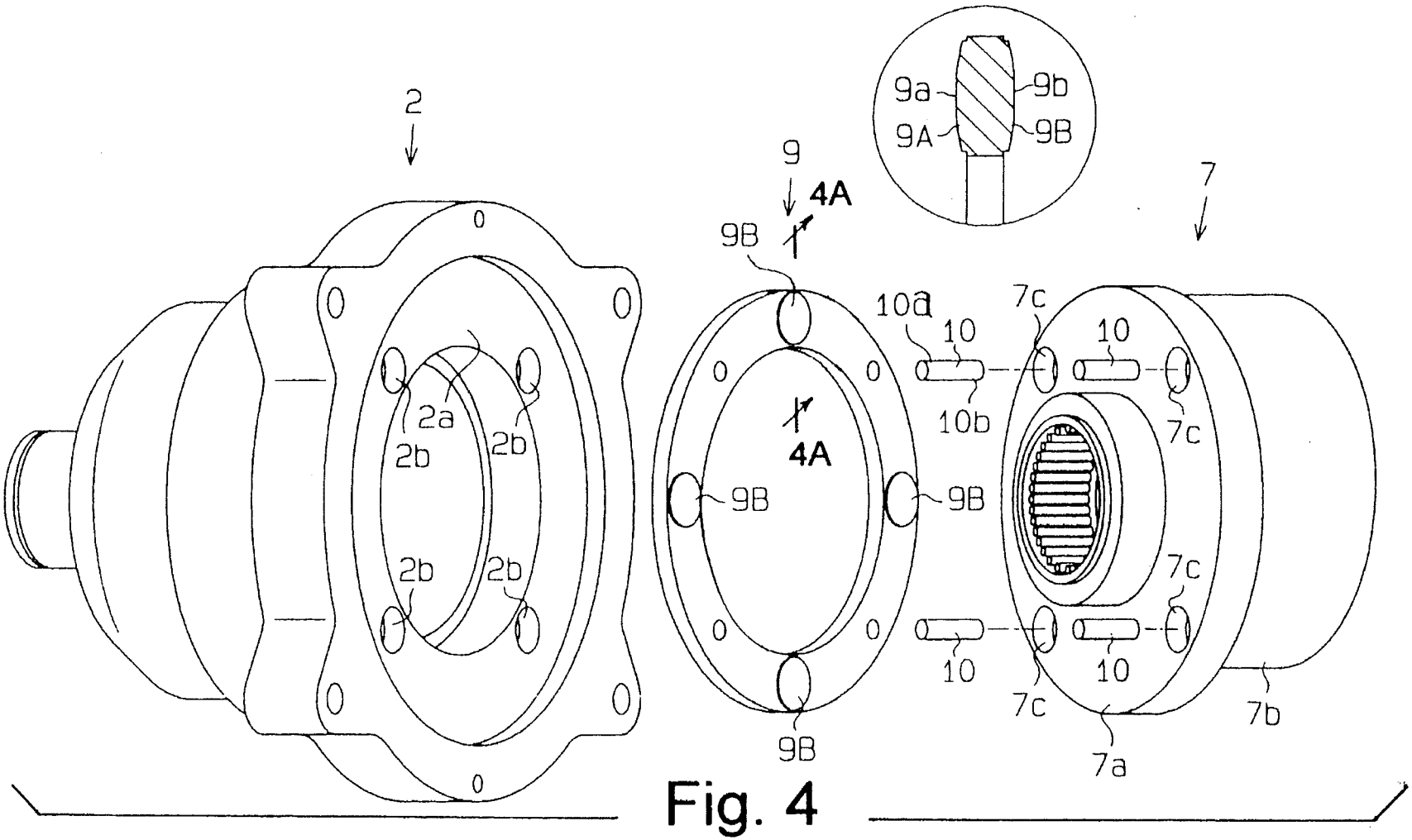
FIG. 4 is an exploded perspective view of the compressor shown in FIG. 1.
FIG. 4A is an enlarged sectional view taken along the line 4A—4A in FIG. 4.
Figure 5:
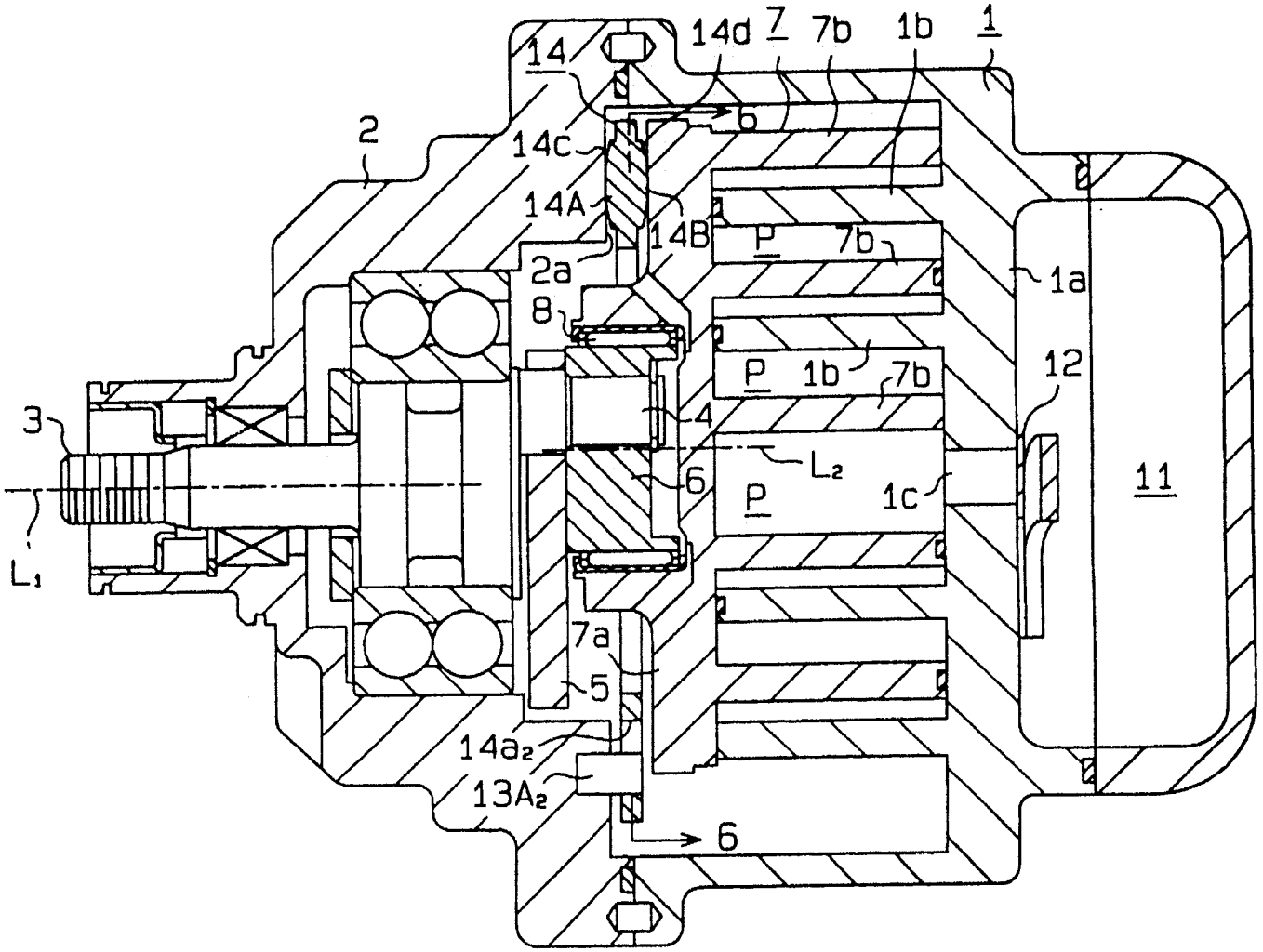
FIG. 5 is a side elevation of a compressor according to a modification of this embodiment.

A ring 9 is disposed between the base plate 7*a* of the orbiting scroll 7 and a pressure receiving wall 2*a* of the front housing 2. The ring 9 has a first and a second flat surfaces facing the pressure receiving wall 2*a* and the base plate 7*a*. The first surface of the ring 9 has a plurality of circular pressure receiving projections 9A formed in the circumferential direction at equal intervals. The second surface of the ring 9 also has circular pressure receiving projections 9B, which are formed in the circumferential direction at equal intervals and are equal in number to the pressure receiving projections 9A. The projections 9A face away from the projections 9B. As shown in FIG. 4, the individual pressure receiving projections 9A and 9B protude toward the base plate 7*a* and the pressure receiving wall 2*a*, respectively and have substantially spherical engagement surfaces 9*a* and 9*b*. The radius of curvature of the engagement surfaces 9*a* and 9*b* is greater than the outside diameter of the base portions of the pressure receiving projections 9A and 9B.

A plurality of columnar rollers 10 for inhibiting the rotation of the orbiting scroll 7 are secured to the ring 9 in the circumferential direction at predetermined intervals. The individual rollers 10 are alternately arranged with the projections 9A and 9B. Each roller 10 has first and second ends 10*a* and 10*b* protruding toward the base plate 7*a* and the pressure receiving wall 2*a* from the first and second surfaces of the ring 9.

The same number of recesses 2*b* as the rollers 10 are formed in the pressure receiving wall 2*a* in the circumferential direction. The same number of recesses 7*c* as the rollers 10 are formed in the base plate 7*a* in the circumferential direction. The individual recesses 2*b* or 7*c* are arranged at equal intervals. The first and second ends 10*a* and 10*b* of the rollers 10 are respectively movably fitted in the recesses 2*b* and 7*c*.

The height from the tops of the engagement surface 9*a* and 9*b* of the projections 9A and 9B to the surfaces of the ends 10*a* and 10*b* of the rollers 10 is smaller than the depth of the recesses 2*b* and 7*c*. Therefore, the surfaces of the ends 10*a* and 10*b* of the rollers 10 will not contact the bottoms of the associated recesses 2*b* and 7*c*.

Given that the diameter of each recess 2*b* or 7*c* is D and the diameter of each roller 10 is d, each roller 10 can move within the recesses 2*b* and 7*c* by the distance corresponding to (D–d). This distance is set equal to the orbit radius r of the bushing 6. Therefore, the diameter D of the recesses 2*b* and 7c, the diameter d of the rollers 10 and the orbit radius r of the bushing 6 satisfy the relation of D=d+r.

Figure 2:
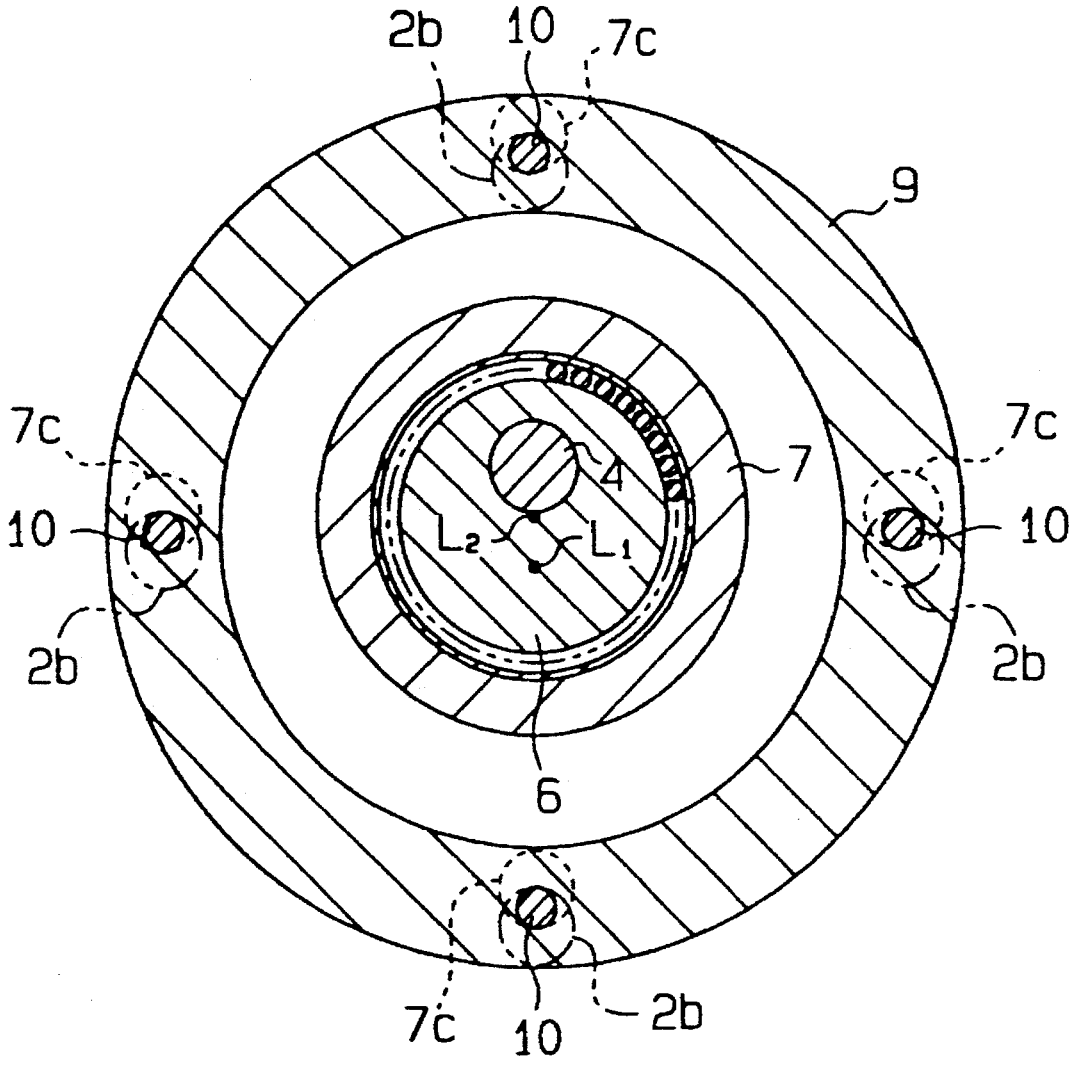
FIG. 2 is a vertical cross section of the compressor taken along line 2—2 in FIG. 1.
Figure 3:
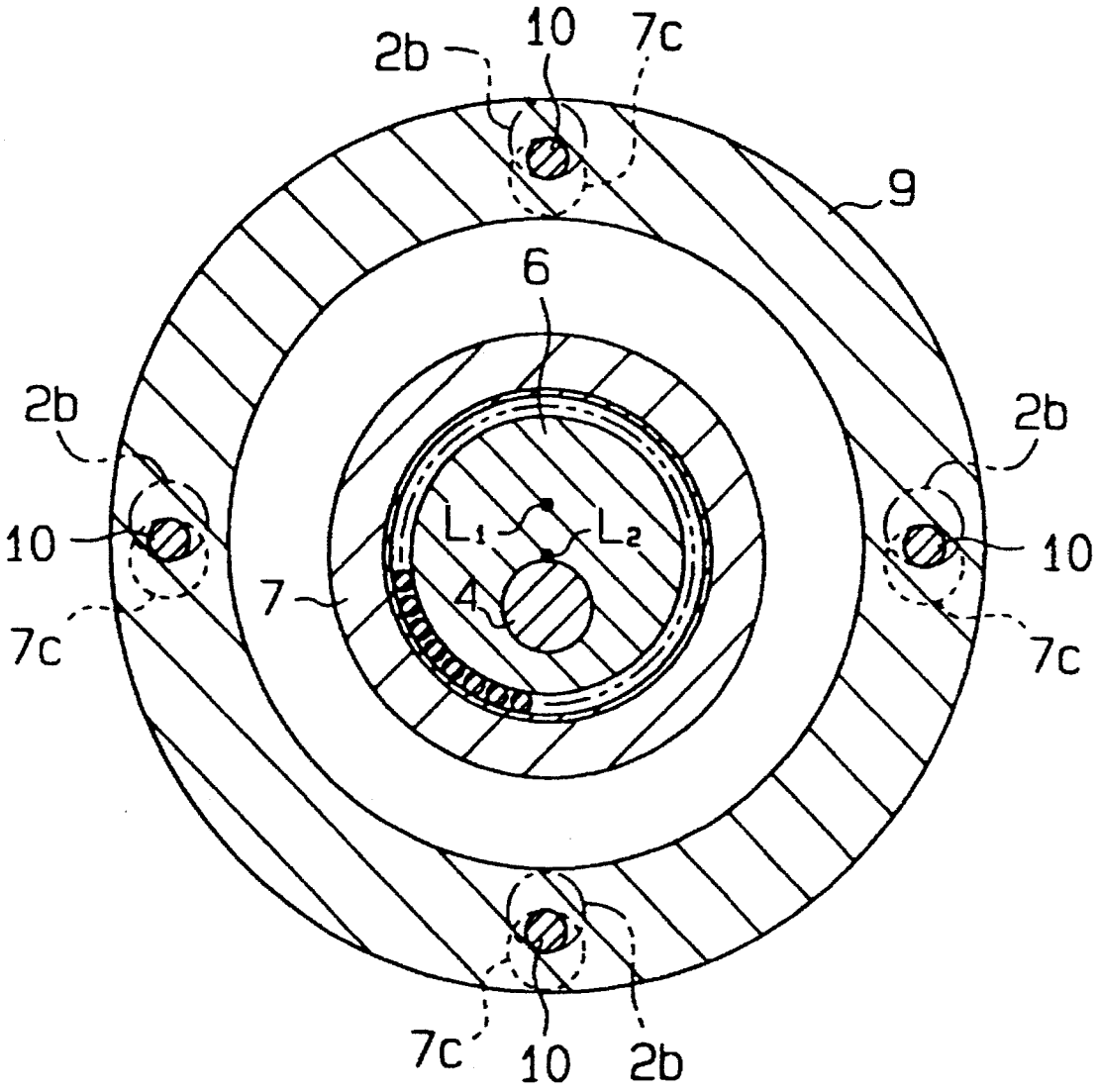
FIG. 3 is a transverse cross section showing the compressor in which an orbiting scroll is revolved by 180 degrees from the position shown in FIG. 2.

FIGS. 2 and 3 show the orbiting scroll 7 in positions 180 degrees opposite to each other. In FIG. 2, the orbiting scroll 7 has revolved to the upper position of its revolution. At this time, the second end 10*b* of each roller 10 is in contact with the lowest portion of the inner wall of the associated recess 7*c* of the base plate 7*a*. In accordance with this contact, the center of the ring 9 (about the same as the axis L2 of the orbiting scroll) is positioned above the axis L1 of the rotary shaft 3, i.e., toward the uppermost position of the orbiting scroll 7. Therefore, the first ends 10*a* of the individual rollers 10 contact the highest portions of the inner walls of the recesses 2*b* of the pressure receiving wall 2*a*, respectively.

When the eccentric shaft 4 moves by 180 degrees from the position shown in FIG. 2, the orbiting scroll 7 moves to the lowermost position of its revolution. During the movement, the second ends 10*b* of the rollers 10 move along the inner walls of the associated recesses 7*c* and contact the uppermost portions thereof. In accordance with this contact, the center of the ring 9 is positioned below the axis L1 of the rotary shaft 3, i.e., toward the lowermost position of the orbiting scroll 7. Therefore, the second ends 10*b* of the individual rollers 10 contact the lowest portions of the inner walls of the recesses 2*b*, respectively.

When the orbiting scroll 7 makes an orbital movement, the range which each roller 10 can move is restricted by the associated recess 2*b* of the pressure receiving wall 2*a* and the associated recess 7*c* of the orbiting scroll 7, which face each other. This range of the movement corresponds to the revolution range that is determined by the orbit radiuses r of the bushing 6 and the orbiting scroll 7. As the orbiting scroll 7 is coupled to the fixed pressure receiving wall 2*a* by those rollers 10, the rotation of the orbiting scroll about the bushing 6 can be prevented.

When the orbiting scroll 7 makes an orbital movement, the second ends 10*b* of the rollers 10 slide in contact with the associated recesses 7*c* of the base plate 7. Therefore, the ring 9 receives the force that urges the ring 9 to rotate about the axis L2 of the bushing 6. However, as the first ends 10*a* of the rollers 10 slide in contact with the associated recesses 2*b* of the fixed pressure receiving wall 2*a*, the rotation of the ring 9 about the axis L2 of the bushing 6 is inhibited while its revolution is allowed.

Figure 9:
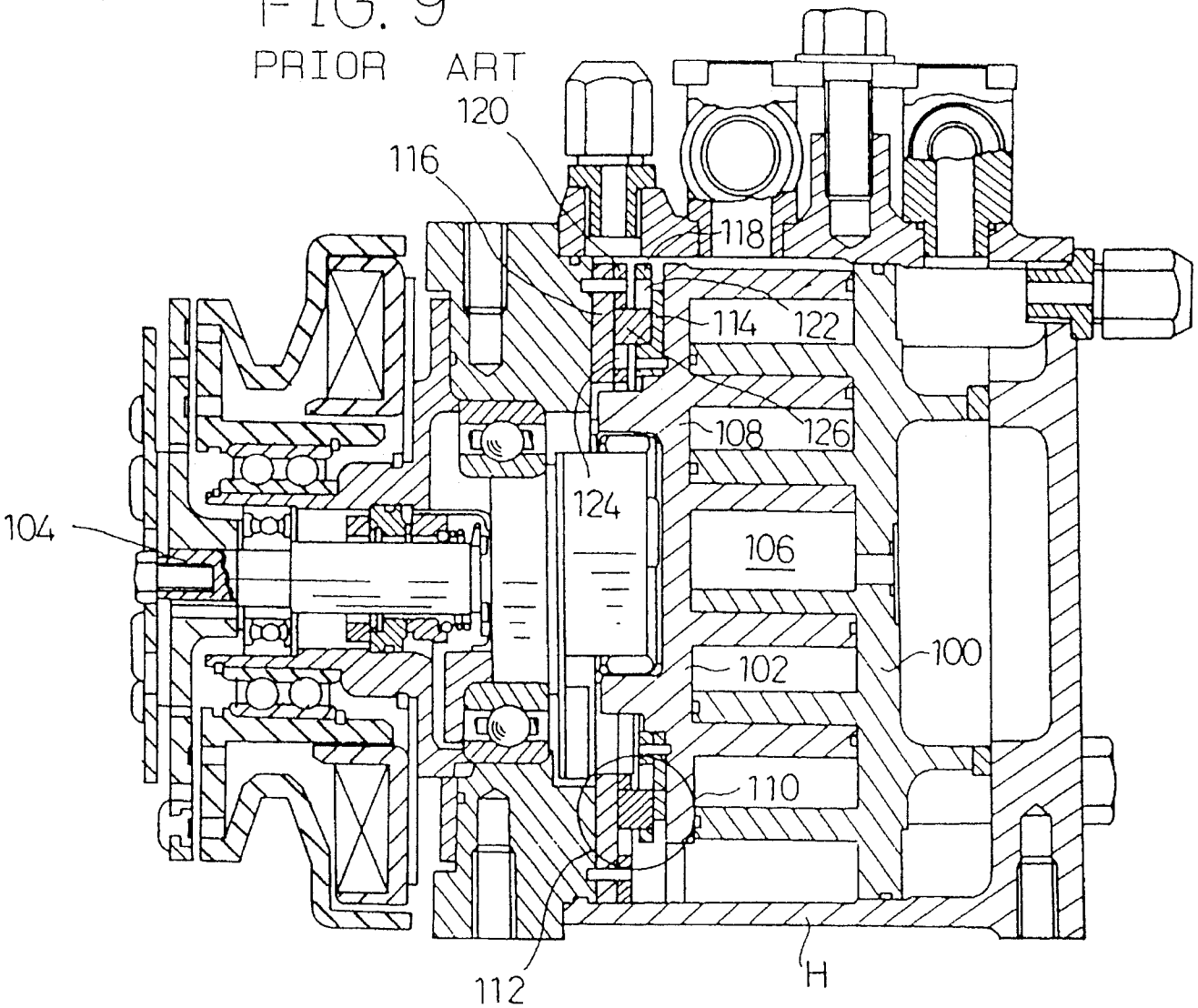
FIG. 9 PRIOR ART
FIG. 9 is a side elevation showing a conventional compressor.
Figure 10:
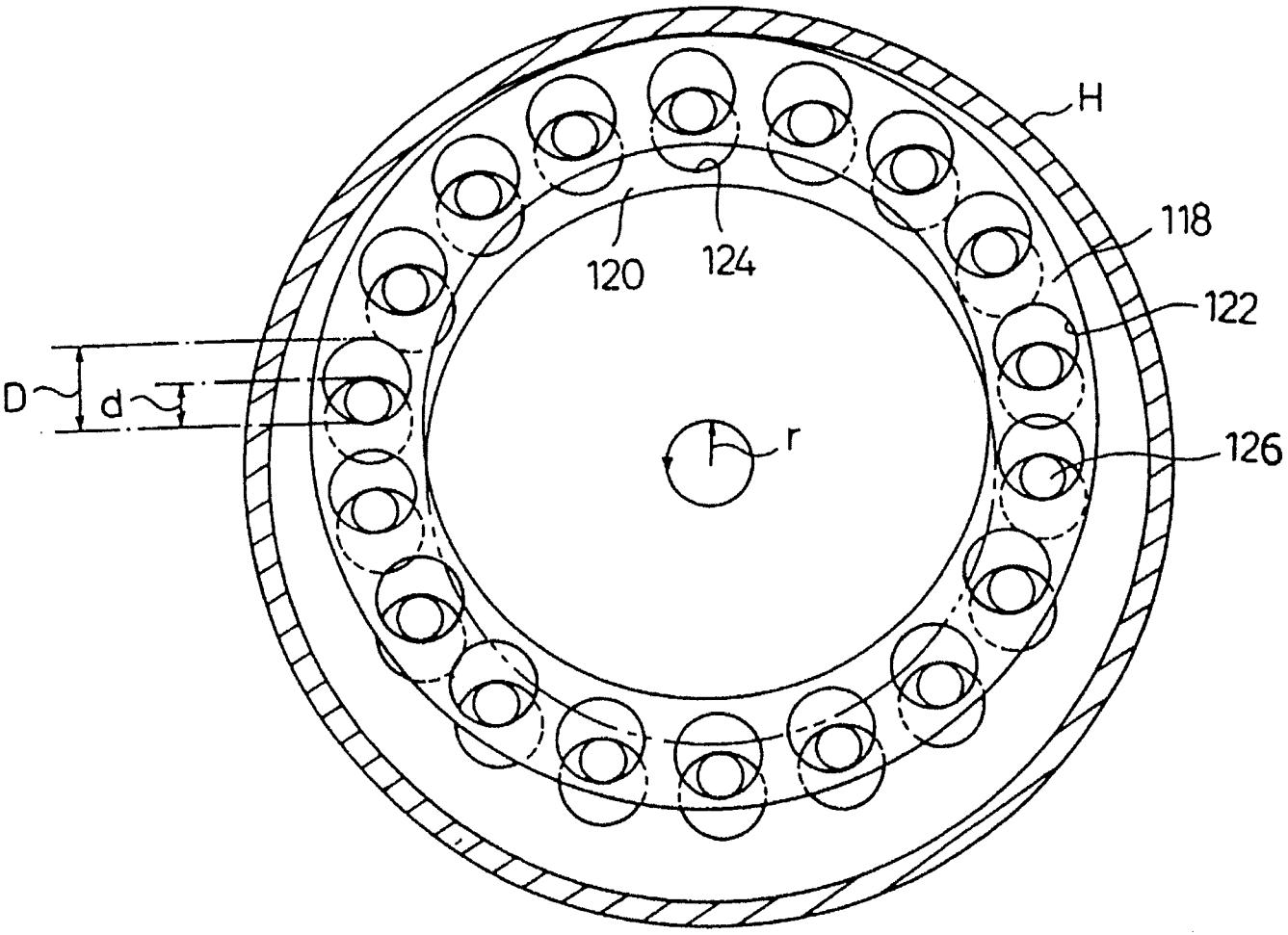
FIG. 10 PRIOR ART
FIG. 10 is a vertical cross section showing the compressor in FIG. 9.

According to this embodiment, the compression reaction force of the gas is transmitted to the pressure receiving wall 2*a* via the engagement of the base plate 7 with the projections 9B and the engagement of the projections 9A with the pressure receiving wall 2*a*. According to the conventional compressor shown in FIG. 9, however, the compression reaction force is transmitted to the fixed race 116 by a plurality of rollers. Since those rollers serve to prevent the rotation of the orbiting scroll in cooperation with the pockets, high precision processing and large number of rollers are needed. This increases the manufacturing cost.

According to this embodiment, the compression reaction force of the gas is also transmitted to the pressure receiving wall 2*a* by means of the projections of the ring 9. It is therefore possible to reduce the number of the rollers 10 to four or even three according to the present embodiment, thus reducing the manufacturing cost accordingly. As only a single ring 9 is required to support those rollers 10, the present compressor can be manufactured at an even still lower cost than the conventional apparatus using two rings.

When the orbiting scroll 7 makes an orbital movement, each roller 10 on the ring 9 is pressed from two different directions by the walls of the front and back recesses 2*b* and 7*c* and tends to tilt. As a result, the whole ring 9 tends to tilt. Under the normal operation of the compressor, however, the ring 9 is held between the base plate 7*a* and the pressure receiving wall 2*a* by the compression reaction force, so that the rollers 10, unlike the rollers of the conventional compressor, will not actually tilt.

If the ring 9 should tilt, it does so when the compression reaction force is low, e.g., when the compressor is activated. However, if the spherical engagement surfaces 9*a* and 9*b* of the projections 9A and 9B have a large radius of curvature, the contact between the surface 9*a* of the projection 9A with the pressure receiving wall 2*a* will not change even if the ring 9 slightly tilts. Likewise, the contact between the surface 9*b* of the projection 9B with the base plate 7*a* will not change. Therefore, the engagement surfaces 9*a* and 9*b* of the projections 9A and 9B will not contact locally to the base plate 7*a* or the pressure receiving wall 2*a*, so that the surfaces 9*a*, 9*b*, base plate 7*a* and wall 2*a* exhibit superior wear characteristics.

Due to the fact that the opposing surfaces of the pressure receiving wall 2*a* and the base plate 7*a* are flat, gaps are formed between the ring 9, the pressure receiving wall 2*a* and the base plate 7*a* at portions other than those which contact the projections. A lubricating oil in the refrigerant gas enters the gaps so that the engagement surfaces 9*a* and 9*b* are always entirely lubricated. As a result, the engagement surfaces 9*a* and 9*b* exhibit superior wear characteristics.

In another embodiment of the present invention, the mechanism for preventing the rotation of the orbiting scroll and the mechanism for receiving the compression reaction force of the gas have different structures from that described in the previous embodiment.

As shown in FIGS. 5 through 8, a pair of columnar fixed elements 13A1 and 13A2 are secured to the pressure receiving wall 2*a* of the front housing 2 which faces the orbiting scroll 7. A pair of columnar movable elements 13B1 and 13B2 are secured to the base plate 7*a*. The fixed elements 13A1 and 13A2 are positioned 180 degrees apart from each other with respect to the axis L1 of the rotary shaft 3. The movable elements 13B1 and 13B2 are likewise positioned 180 degrees apart from each other with respect to the axis L2 of the bushing 6.

A ring 14, disposed between the base plate 7*a* and the front housing 2, has four holes 14*a*1, 14*a*2, 14*b*1 and 14*b*2 formed in the circumferential direction at phase differences of 90 degrees. The two holes 14*a*1 and 14*a*2 are 180 degrees apart from each other with respect to the rotational center of the ring 14, while the two holes 14*b*1 and 14*b*2 are 180 degrees apart from each other with respect to the rotational center of the ring 14.

Figure 7:
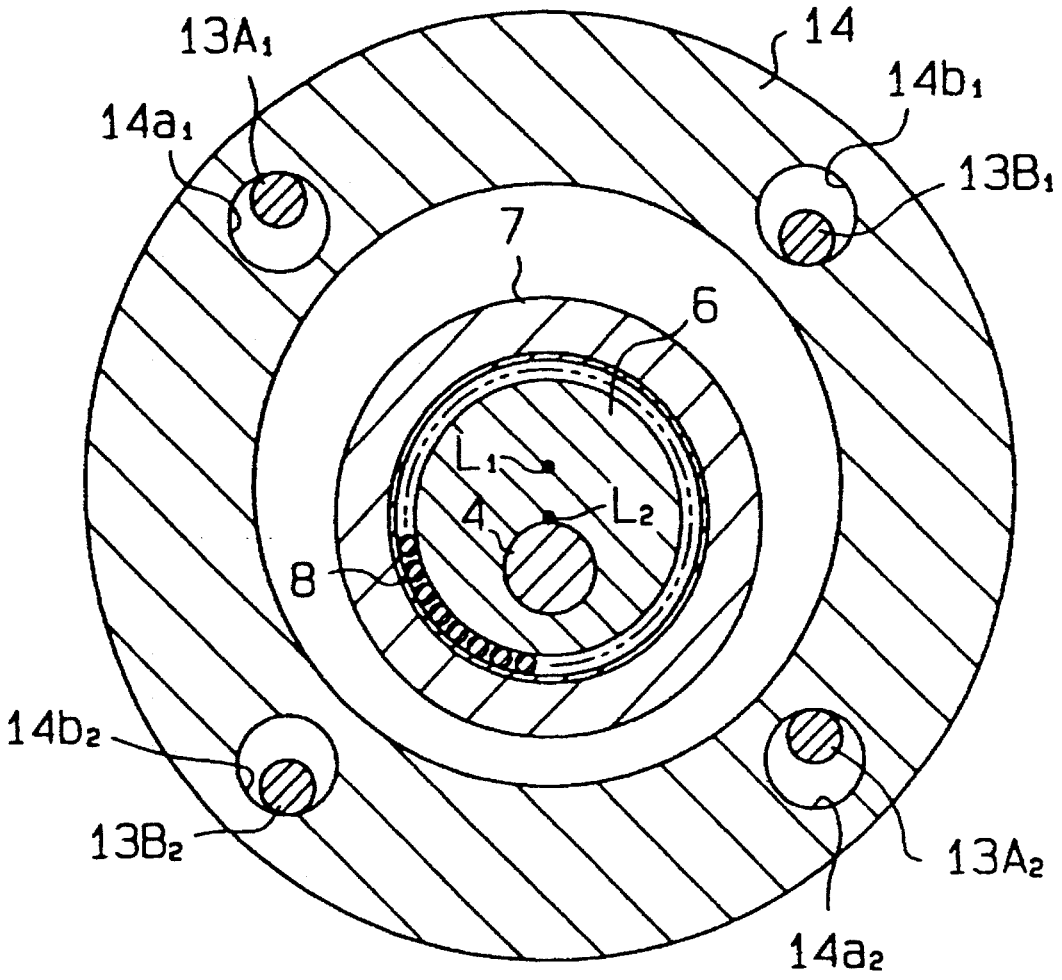
FIG. 7 is a transverse cross section showing the compressor in which an orbiting scroll is revolved by 180 degrees from the position shown in FIG. 6.
Figure 8:
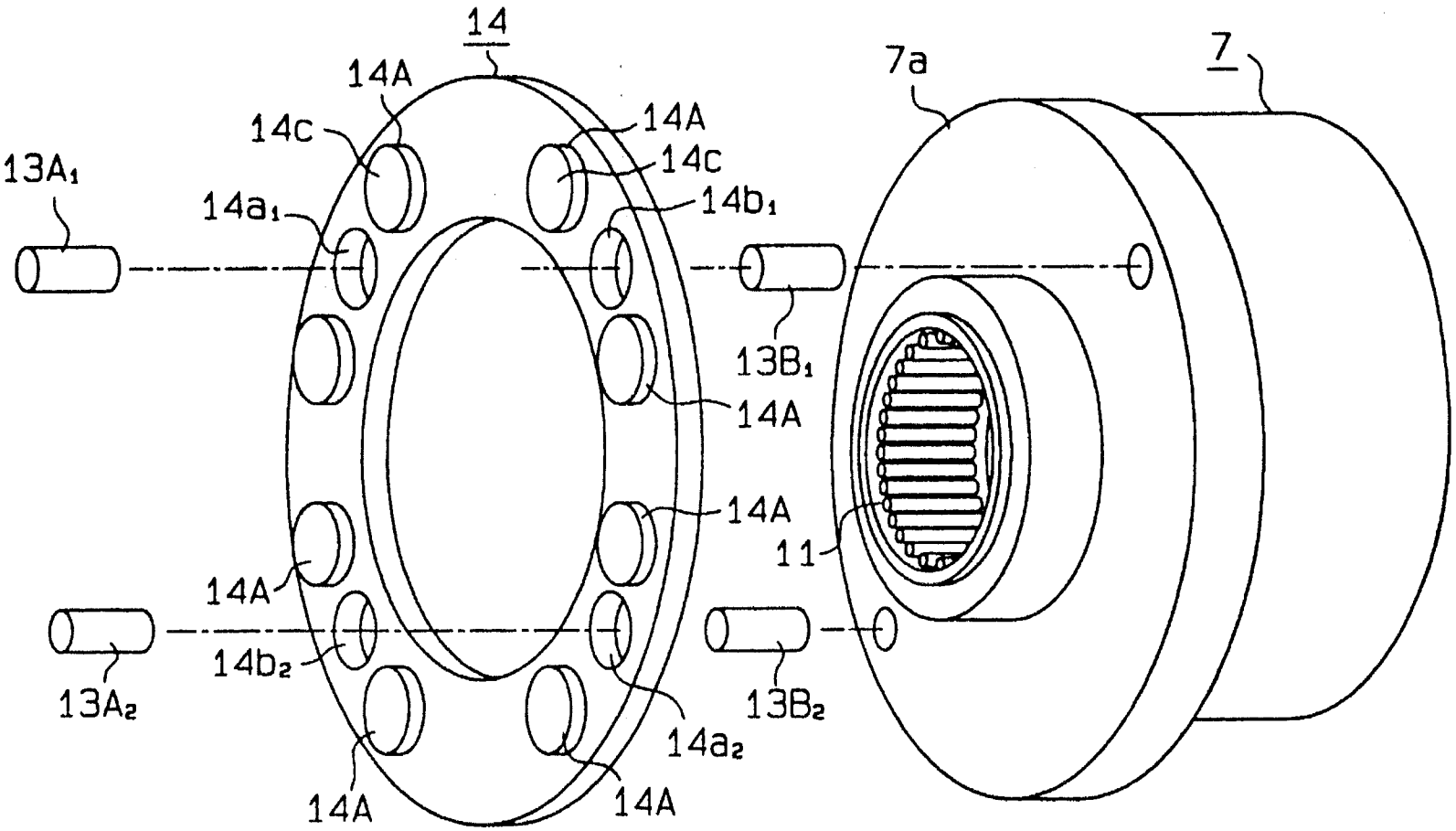
FIG. 8 is an exploded perspective view of the compressor shown in FIG. 5.

FIG. 8 is an exploded perspective view showing the orbiting scroll 7, fixed elements 13A1 and 13A2, movable elements 13B1 and 13B2 and ring 14. As shown in FIGS. 5 through 8, the fixed elements 13A1 and 13A2 are fitted in respective holes 14*a*1 and 14*a*2 for the pressure receiving wall 2*a*. Movable elements 13B1 and 13B2 are fitted in respective holes 14*b*1 and 14*b*2 for the orbiting scroll 7. Thus, the fixed elements 13A1 and 13A2 and the movable elements 13B1 and 13B2 are alternately arranged.

A plurality of projections 14A and 14B are integrally formed on both surfaces of the ring 14. A pair of projections 14A and a pair of projections 14B are located between every pair of adjoining holes 14*a*1, 14*a*2, 14*b*1 and 14*b*2. The projections 14A and 14B transmit the compression reaction force of the gas in the compression chamber P, which acts on the orbiting scroll 7, to the pressure receiving wall 2*a* of the front housing 2. The projections 14A and 14B have engagement surfaces 14*c* and 14*d* curved to have large radii like in the previous embodiment.

Figure 6:
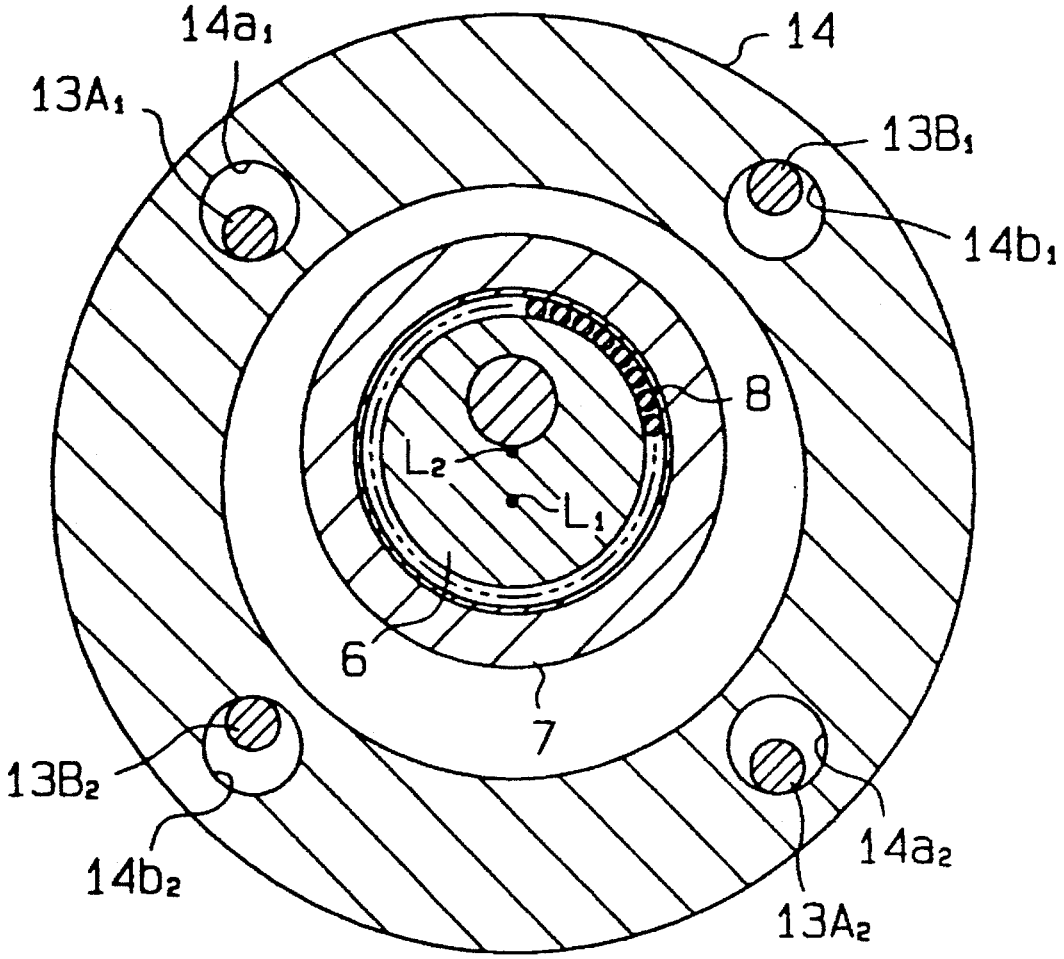
FIG. 6 is a vertical cross section of the compressor taken along line 6—6 in FIG. 5.

FIGS. 6 and 7 show the orbiting scroll 7 in positions 180 degrees opposite to each other. In FIG. 6, the orbiting scroll 7 has revolved to the upper limit of its revolution. At this time, the movable elements 13B1 and 13B2 are in contact with the uppermost portions of the inner walls of the associated holes 14*b*1 and 14*b*2. Accordingly, the center of the ring 14 (about the same as the axis L2 of the orbiting scroll) is moved toward the uppermost position of the revolution range of the orbiting scroll 7. The lowermost portions of the inner walls of the holes 14*a*1 and 14*a*2 therefore contact the fixed elements 13A1 and 13A2, respectively.

When the eccentric shaft 4 moves by 180 degrees from the position shown in FIG. 6, the orbiting scroll 7 moves to the lowermost position of its revolution. As a result, the movable elements 13B1 and 13B2 contact with the lowermost portions of the inner walls of the associated holes 14*b*1 and 14*b*2. At this time, the center of the ring 14 is moved toward the lowermost position of the revolving the orbiting scroll 7 with respect to the axis L1 of the rotary shaft 3. Therefore, the uppermost portions of the inner walls of the holes 14*a*1 and 14*a*2 contact the fixed elements 13A1 and 13A2, respectively.

Given that the diameter of each of the holes 14*a*1, 14*a*2, 14*b*1 and 14*b*2 is D and that the diameter of the each fixed elements 13A1 and 13A2 and the movable elements 13B1 and 13B2 is d, the position of the movable elements 13B1 and 13B2 change by 2(D–d). This distance is two times the orbit radius r of the bushing 6. Therefore, the diameter D of the holes 14*a*1, 14*a*2, 14*b*1 and 14*b*2 is D, the diameter d of the fixed elements 13A1 and 13A2 and the movable elements 13B1 and 13B2, and the orbit radius r of the bushing 6 satisfy the relation of D=d+2r. The radius of the orbiting scroll 7 is defined by this relation.

A pair of movable elements 13B1 and 13B2 tend to revolve about the axis L2 of the bushing 6. A pair of fixed elements 13A1 and 13A2, unlike the movable elements 13B1 and 13B2, are secured to the front housing 2. Therefore, the fixed element 13A1 which contacts the hole 14*a*1 prevents the rotation of the ring 14 in one direction, while the fixed element 13A2 which contacts the hole 14*a*2 prevents the rotation of the ring 14 in the other direction. Accordingly, the orbiting scroll 7 will not rotate about the axis L2 of the bushing 6.

In this embodiment, only the single pair of holes 14*a*1 and 14*a*2 are provided for the pair of fixed elements 13A1 and 13A2, and the single pair of holes 14*b*1 and 14*b*2 for the pair of movable elements 13B1 and 13B2. This reduces the precision, time and cost needed to manufacture the compressor.

In this embodiment, gaps are also formed between the engagement surface 14*c* of the projection 14A and the pressure receiving wall 2*a* and between the engagement surface 14*d* of the projection 14B and the base plate 7*a*. A lubricating oil in the refrigerant gas likewise enters the gaps so that the engagement surfaces 14*c* and 14*d* are always entirely lubricated. As a result, the engagement surfaces 14*a* and 14*b* are less likely to wear.

What is claimed is:

1. A scroll type compressor having a fixed scroll and a movable scroll revolvably supported, facing said fixed scroll, with a compression chamber defined between said fixed and movable scrolls, in order to provide compressed gas, said compressor comprising:

a pressure receiving member for receiving the compression reaction force of said gas produced in said compression chamber which acts on said movable scroll;

a base plate provided on said movable scroll;

a turnable ring disposed between said pressure receiving member and said base plate, said ring having first and second surfaces respectively facing said pressure receiving member and said base plate;

a plurality of first elements each associated with and fitted into a respective one of a plurality of first recesses, said first elements and first recesses being disposed between said pressure receiving member and said first surface of said turnable ring with said first elements being disposed at predetermined circumferentially spaced intervals on one of said pressure receiving member and said first surface of said turnable ring, and said first recesses being correspondingly disposed in the other of said pressure receiving member and said first surface of said turnable ring;

a plurality of second elements each associated with and fitted into a respective one of a plurality of second recesses, said second elements and second recesses being disposed between said base plate and said second surface of said turnable ring with said second elements being disposed at predetermined circumferentially spaced intervals on one of said base plate and said second surface of said turnable ring, and said second recesses being correspondingly disposed in the other of said base plate and said second surface of said turnable ring, whereby when said movable scroll revolves, said first and second elements move within said first and second recesses to prevent rotation of said movable scroll and said turnable ring; and a plurality of projections provided on said first and second surfaces of said turnable ring to transmit said compression reaction force of said compressed gas, said projections protruding toward said pressure receiving member and said base plate and having projective engagement surfaces to engage said pressure receiving member and said base plate.

2. The scroll type compressor according to claim 1, wherein said projections have circularly formed base portions adjacent the corresponding surface of said ring, and wherein each of said engagement surfaces has a radius of curvature greater than an outside diameter of each of said base portions.

3. The scroll type compressor according to claim 1, wherein said plurality of first elements and said plurality of second elements are columnar in shape, and are provided on said first and second surfaces of said ring.

4. The scroll type compressor according to claim 3, wherein said plurality of first and second elements are columnar shaped rollers formed integral to and penetrating said turnable ring.

5. The scroll type compressor according to claim 4, wherein said rollers and said projections are alternately arranged circumferentially.

6. The scroll type compressor according to claim 1, wherein said plurality of first and second elements are columnar in shape, said first elements being provided on said pressure receiving member, said second elements being provided on said base plate, and said first and second recesses being provided in said turnable ring.

7. The scroll type compressor according to claim 6, wherein said first and second recesses and said projections are alternately arrange circumferentially.

8. The scroll type compressor according to claim 7, wherein said projections have circularly formed base portions adjacent the corresponding surface of said ring, and wherein each of said engagement surfaces has a radius of curvature greater than an outside diameter of each of said base portions.

9. A scroll type compressor having a fixed scroll and a movable scroll revolvably supported, facing said fixed scroll, with a compression chamber defined between said fixed and movable scrolls, in order to provide compressed gas, said compressor comprising:

a pressure receiving member for receiving the compression reaction force of said compressed gas produced in said compression chamber which acts on said movable scroll;

a base plate provided on said movable scroll;

a turnable ring disposed between said pressure receiving member and said base plate, said ring having a first and a second surface respectively facing said pressure receiving member and said base plate;

a plurality of first elements circumferentially spaced and provided at predetermined intervals on the first surface of said turnable ring;

a plurality of first recesses provided in said pressure receiving member, said first elements being fitted into said first recesses respectively;

a plurality of second elements circumferentially spaced and provided at predetermined intervals on the second surface of said turnable ring;

a plurality of second recesses provided in said base plate, said second elements being fitted into said second recesses respectively, whereby when said movable scroll revolves, said first and second elements move within said first and second recesses to prevent rotation of said movable scroll and said ring; and a plurality of projections provided on said first and second surfaces of said turnable ring to transmit said compression reaction force of said compressed gas, said projections protruding toward said pressure receiving member and said base plate and having projective engagement surfaces to engage said pressure receiving member and said base plate.

10. The scroll type compressor according to claim 9, wherein said projections have circularly formed base portions adjacent the corresponding surface of said ring, and wherein each of said engagement surfaces has a radius of curvature greater than an outside diameter of each of said base portions.

* * * * *